US010457523B2

(12) United States Patent
Fauconnet et al.

(10) Patent No.: US 10,457,523 B2
(45) Date of Patent: Oct. 29, 2019

(54) GUIDE RAIL SUPPORT CONFIGURED TO ACCOUNT FOR BUILDING SETTLING

(71) Applicant: Otis Elevator Company, Farmington, CT (US)

(72) Inventors: Aurelien Fauconnet, Isdes (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 287 days.

(21) Appl. No.: 15/471,145

(22) Filed: Mar. 28, 2017

(65) Prior Publication Data

US 2017/0297867 A1 Oct. 19, 2017

(30) Foreign Application Priority Data

Apr. 15, 2016 (EP) ..... 16305448

(51) Int. Cl.
*B66B 7/02* (2006.01)

(52) U.S. Cl.
CPC ..... *B66B 7/024* (2013.01); *B66B 7/023* (2013.01)

(58) Field of Classification Search
CPC ..... B66B 7/023; B66B 7/024
See application file for complete search history.

(56) References Cited

U.S. PATENT DOCUMENTS 2,321,106 A * 6/1943 Sanford ..... B66B 7/02 187/408
2,848,077 A * 8/1958 Tofanelli ..... B66B 7/02 187/408
3,087,583 A 4/1963 Bruns
3,199,642 A * 8/1965 Anderson ..... B66B 7/02 187/408

(Continued)

FOREIGN PATENT DOCUMENTS

CN 201201832 Y 3/2009
CN 201494984 6/2010

(Continued)

OTHER PUBLICATIONS

European Search Report, European Application No. 16305448.9, dated Sep. 26, 2016, European Patent Office; European Search Report 7 pages.

*Primary Examiner* — Minh Truong
(74) *Attorney, Agent, or Firm* — Cantor Colburn LLP

(57) ABSTRACT

A guide rail support of an elevator includes a guide rail bracket having a first side, a second side, a first mounting portion, and a second mounting portion. The first mounting portion is attachable to an elevator shaft and the guide rail bracket has inclined apertures in the second mounting portion. An adjustment bracket is configured to contact the second side at the second mounting portion, the adjustment bracket having inclined apertures configured to align with the inclined apertures of the guide rail bracket to define stem apertures. First and second rotating members are installed (Continued)

through the stem apertures. Each rotating member has (i) a rotating head that movably engages with a guide rail, (ii) an integrally formed stem configured to pass through a respective stem aperture, and (iii) a middle defining a length that is greater than a thickness of the guide rail bracket and the adjustment bracket.

15 Claims, 9 Drawing Sheets

(56) References Cited

U.S. PATENT DOCUMENTS

| | | | | |
|---|---|---|---|---|
| 3,420,337 | A | 1/1969 | Magee | |
| 4,251,030 | A * | 2/1981 | Marchant | B66B 7/024 238/347 |
| 4,431,087 | A * | 2/1984 | Karol | B66B 7/024 187/408 |
| 4,577,729 | A | 3/1986 | Karol | |
| 5,984,053 | A | 11/1999 | Lee et al. | |
| 6,196,356 | B1 * | 3/2001 | Sneed | B66B 7/024 187/408 |
| 6,345,698 | B1 | 2/2002 | Ravishankar | |
| 7,389,940 | B2 | 6/2008 | Kurzo | |
| 7,562,749 | B2 | 7/2009 | Race, Sr. et al. | |
| 7,752,978 | B2 | 7/2010 | Schroeder | |
| 9,242,835 | B2 * | 1/2016 | Bjorni | B66B 7/024 |
| 2012/0133164 | A1 | 5/2012 | Jesus et al. | |
| 2014/0069746 | A1 | 3/2014 | Fargo et al. | |
| 2014/0102833 | A1 | 4/2014 | Arai et al. | |
| 2014/0158473 | A1 | 6/2014 | Arai et al. | |
| 2014/0326545 | A1 * | 11/2014 | Bjorni | B66B 7/024 187/408 |

FOREIGN PATENT DOCUMENTS

| | | | |
|---|---|---|---|
| CN | 102923548 | A | 2/2013 |
| CN | 202864616 | U | 4/2013 |
| CN | 103287945 | A | 9/2013 |
| CN | 203199845 | U | 9/2013 |
| CN | 203715023 | U | 7/2014 |
| CN | 204082951 | U | 1/2015 |
| CN | 204607320 | U | 9/2015 |
| CN | 204938665 | U | 1/2016 |
| CN | 204980718 | U | 1/2016 |
| EP | 0448839 | A1 | 10/1991 |
| GB | 806965 | | 1/1959 |
| JP | 2013056718 | A | 3/2013 |
| WO | 2012024931 | | 3/2012 |

* cited by examiner

GUIDE RAIL SUPPORT CONFIGURED TO ACCOUNT FOR BUILDING SETTLING

CROSS-REFERENCE TO RELATED APPLICATIONS

The present application claims priority from European Patent Application No. 16305448.9, filed Apr. 15, 2016. The contents of the priority application are hereby incorporated by reference in their entirety.

BACKGROUND

The subject matter disclosed herein generally relates to elevator systems and, more particularly, to guide rail supports configured to account for building settling.

Current elevator systems use one type of guide rail to form a guide rail track upon which an elevator car and/or counterweight may travel. For proper operation and/or safety, various forces must be considered when designing and constructing an elevator guide rail. Such considerations may require specific guide rail sizing which may impact the total weight and cost of the installation of an elevator system within a building. For example, the taller a building and elevator system is, the stronger the guide rail needs to be. Thus, for taller and/or larger buildings or other structures that include elevator systems, relatively large guide rails may be required to support the weight of the elevator car(s) and/or counterweight(s) and the associated forces generated thereby. On current designs, one size guide rail, i.e., one cross-sectional shape, is used to make a single or whole guide rail track.

One factor that may impact the forces exerted upon a guide rail track is the force of the building during settling over time. If the settling forces become too great, the guide rail may suffer from a stress within a cross-section of the guide rail or other negative impacts.

SUMMARY

According to one embodiment, a guide rail support for a guide rail of an elevator system is provided. The guide rail support includes a guide rail bracket having a first side, a second side opposite the first side, a first mounting portion, and a second mounting portion, the first mounting portion configured to fixedly attach to a wall of an elevator shaft, the guide rail bracket having at least two inclined apertures formed in the second mounting portion; an adjustment bracket configured to contact the second side of the guide rail bracket at the second mounting portion, the adjustment bracket having at least two inclined apertures configured to align with the inclined apertures of the guide rail bracket to define a stem aperture; and a first rotating member configured to be installed through one of the stem apertures; a second rotating member configured to be installed through the other of the stem apertures, wherein each rotating member has (i) a first end defining a rotating head configured to movably engage with a base of a guide rail, (ii) an integrally formed stem configured to pass through the respective stem aperture and define a second end, and (iii) a middle integrally formed between the first end and the second end, the middle defining a length that is greater than a thickness of the guide rail bracket and the adjustment bracket.

In addition to one or more of the features described above, or as an alternative, further embodiments of the guide rail supports may include that the inclined apertures of the guide rail bracket are rectangular to the inclined apertures of the adjustment bracket.

In addition to one or more of the features described above, or as an alternative, further embodiments of the guide rail supports may include that the inclined apertures of the adjustment bracket are set at about 45° from horizontal.

In addition to one or more of the features described above, or as an alternative, further embodiments of the guide rail supports may include at least one bracket fastener configured to fixedly connect the adjustment bracket to the guide rail bracket.

In addition to one or more of the features described above, or as an alternative, further embodiments of the guide rail supports may include at least one wall fastener configured to fixedly connect the guide rail bracket to a wall of an elevator shaft.

In addition to one or more of the features described above, or as an alternative, further embodiments of the guide rail supports may include that the first mounting portion includes one or more vertical apertures configured to align with one or more securing apertures formed in the adjustment bracket.

In addition to one or more of the features described above, or as an alternative, further embodiments of the guide rail supports may include that the middle of each rotating member includes a stop surface configured to stop a part of a stem fastener that engages with the stem of the rotating member such that a gap is formed between the stem fastener and a surface of the adjustment bracket.

In addition to one or more of the features described above, or as an alternative, further embodiments of the guide rail supports may include that the gap is about 0.1 mm.

In addition to one or more of the features described above, or as an alternative, further embodiments of the guide rail supports may include that each rotating member includes an engagement portion defined by a first surface and a second surface, the first surface being inclined relative to the second surface, the engagement portion configured to receive a portion of a guide rail.

In addition to one or more of the features described above, or as an alternative, further embodiments of the guide rail supports may include that the stem apertures are separated by a first separation distance when the adjustment bracket is in a first position and the stem apertures are separated by a second separation distance when the adjustment bracket is in a second position In addition to one or more of the features described above, or as an alternative, further embodiments of the guide rail supports may include that each rotating member includes a clamp-like structure configured to engage with the guide rail.

According to another embodiment, a method of installing a guide rail in an elevator shaft is provided. The method includes installing two rotating members into a guide rail support, wherein the rotating members each include an integral stem that is installed through a stem aperture formed through the guide rail support having a guide rail bracket and an adjustment bracket; adjusting the relative positions of the stem apertures by adjusting the position of the adjustment bracket relative to the guide rail bracket; engaging a guide rail between the two rotating members such that the rotating members are rotatable with respect to the guide rail; and fixedly connecting the guide rail bracket to the adjustment bracket.

In addition to one or more of the features described above, or as an alternative, further embodiments of the method may include fixedly connecting the guide rail bracket to a wall of an elevator shaft.

In addition to one or more of the features described above, or as an alternative, further embodiments of the method may include adjusting the position of the stem aperture between (i) a first position where the stem apertures are separated by a first separation distance and (ii) a second position where the stem apertures are separated by a second separation distance, wherein the first separation distance is greater than the second separation distance.

In addition to one or more of the features described above, or as an alternative, further embodiments of the method may include securing the guide rail bracket and the adjustment bracket between a first end of the rotating members and a stem fastener attached at a second end of the rotating members, wherein a gap is formed between the stem fasteners and the adjustment bracket.

Technical effects of embodiments of the present disclosure include a guide rail support configured to engage with a guide rail that enables a building to settle within imparting forces upon the guide rail. Further technical effects include a guide rail support having a guide rail bracket and an adjustment bracket that are configured to function together to allow for adjustment of rotating members relative to a guide rail during installation.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
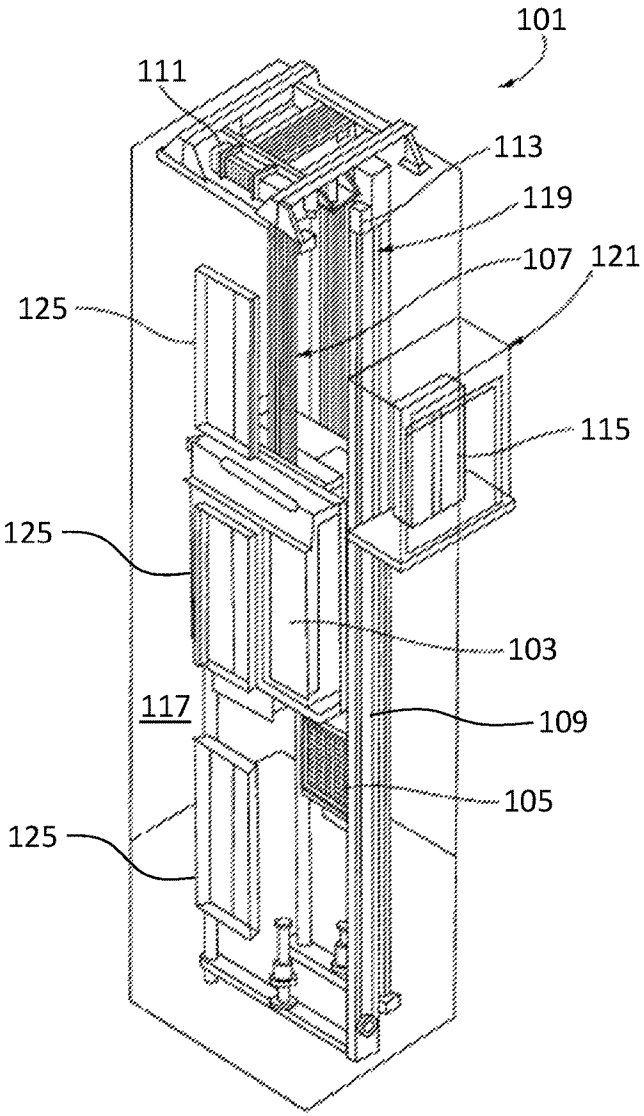
FIG. 1A is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1A is merely a non-limiting example presented for illustrative and explanatory purposes.

Figure 1B:
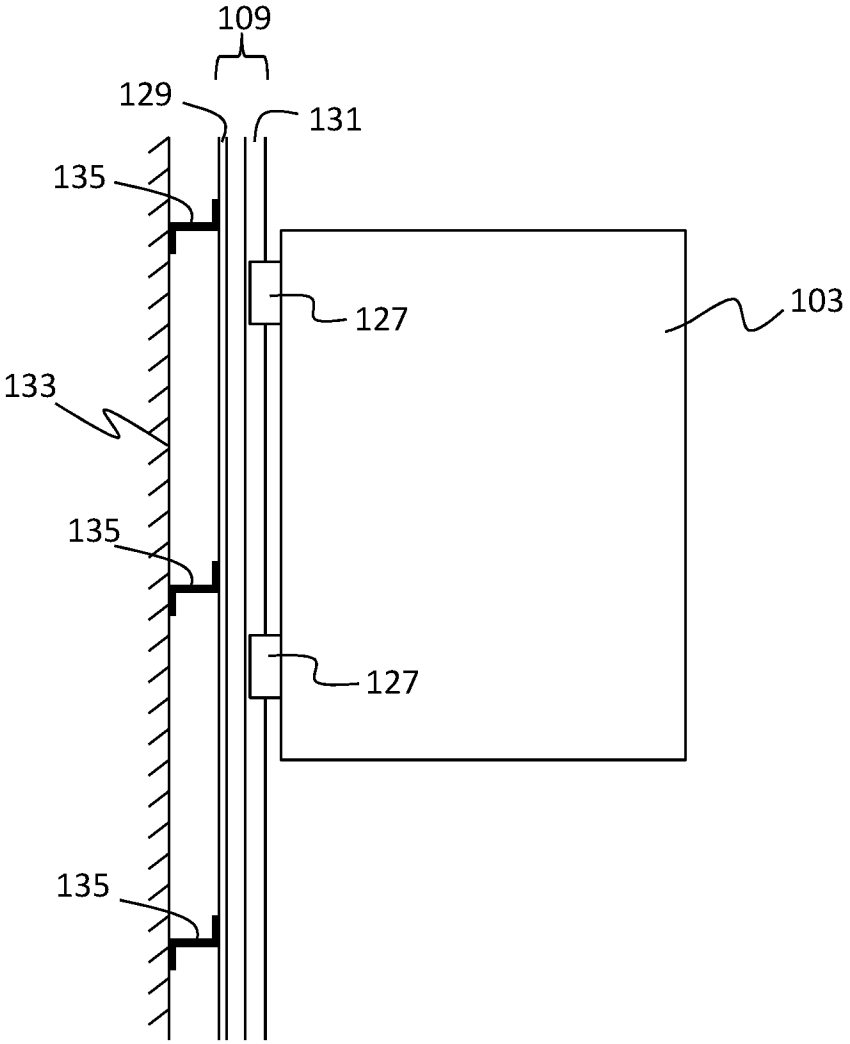
FIG. 1B is a side schematic illustration of an elevator car of FIG. 1A attached to a guide rail track.

FIG. 1B is a side view schematic illustration of the elevator car 103 as operably connected to the guide rail 109. As shown, the elevator car 103 connects to the guide rail 109 by one or more guiding devices 127. The guiding devices 127 may be a guide shoe, a roller, etc. The guide rail 109 defines a guide rail track that has a base 129 and a blade 131 extending therefrom. The guiding devices 127 are configured to run along and/or engage with the blade 131. The guide rail 109 mounts to a wall 133 of the elevator shaft 117 by one or more guide rail supports 135. The guide rail supports 135 are configured to fixedly mount to the wall 133 and the base 129 of the guide rail 109 fixedly attaches to the guide rail supports 135. As will be appreciated by those of skill in the art, a guide rail of a counterweight of an elevator system may be similarly configured.

During settling of a building, over time, the building (through wall 133) will impart a force upon the guide rail supports 135. The guide rail supports 135 will thus impart a force on to the guide rail 109, which may lead to stresses imposed upon the guide rail 109. Accordingly, to account for and absorb the additional forces, guide rails may be required to be increased in size, material strength, or other change which may impart additional costs and/or size constraints during design and construction of an elevator system.

In view of the above, guide rail supports configured to account for building settling are provided that eliminate the need to change the design or structure of a guide rail. For example, embodiments provided herein include guide rail supports that have rotary elements operably connected to the guide rail support such that as a building settles, the guide rail supports may move relative to the guide rails without applying addition forces and/or stresses upon the guide rails.

Figure 2B:
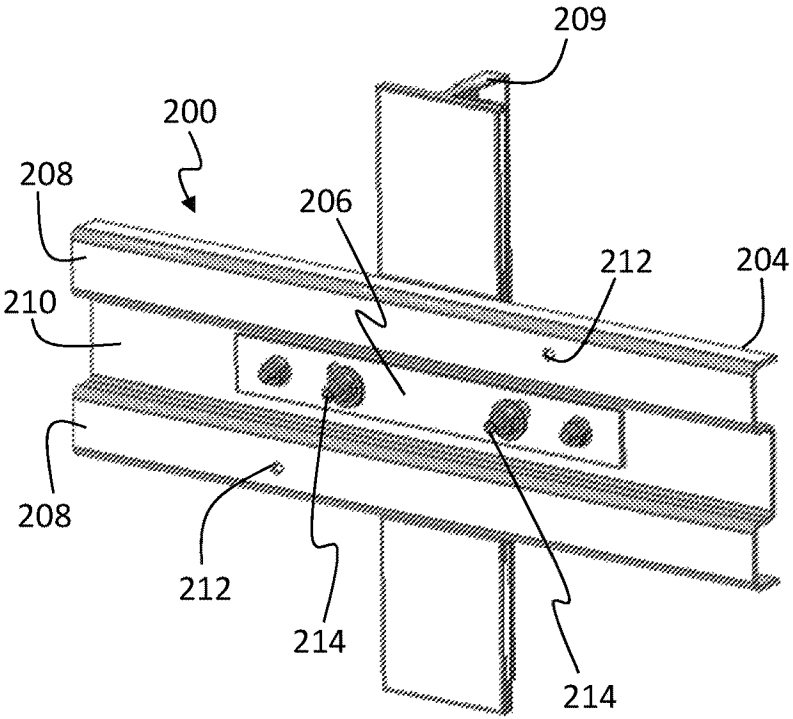
FIG. 2B is a second perspective illustration of the guide rail support of FIG. 2A as engaged with the guide rail.
Figure 2A:
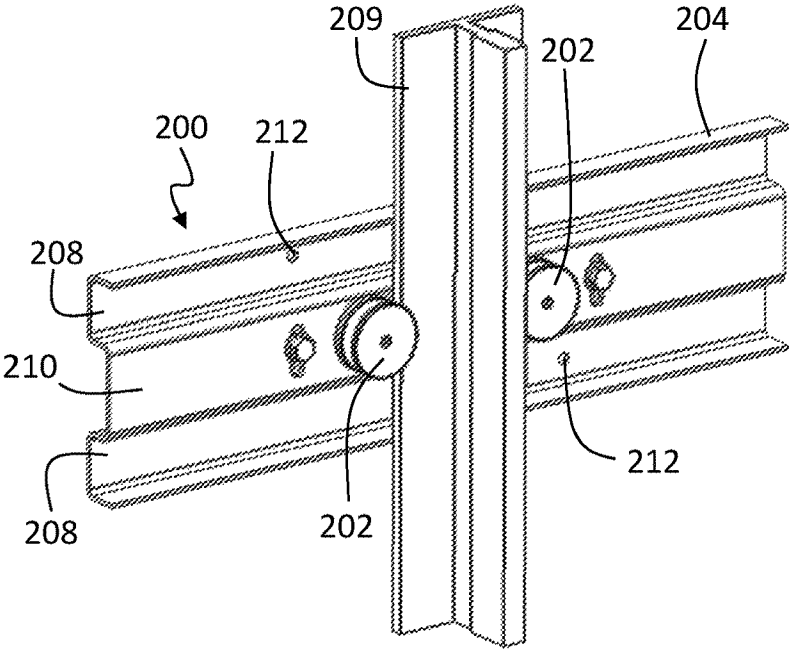
FIG. 2A is a first perspective illustration of a guide rail support in accordance with an embodiment of the present disclosure as engaged with a guide rail.
Figure 2C:
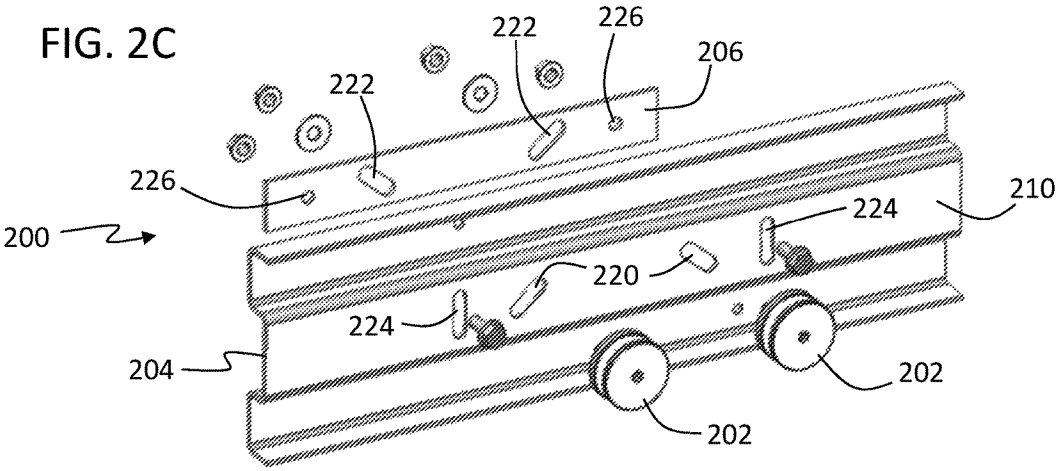
FIG. 2C is a first perspective, exploded illustration of the guide rail support of FIG. 2A.
Figure 2D:
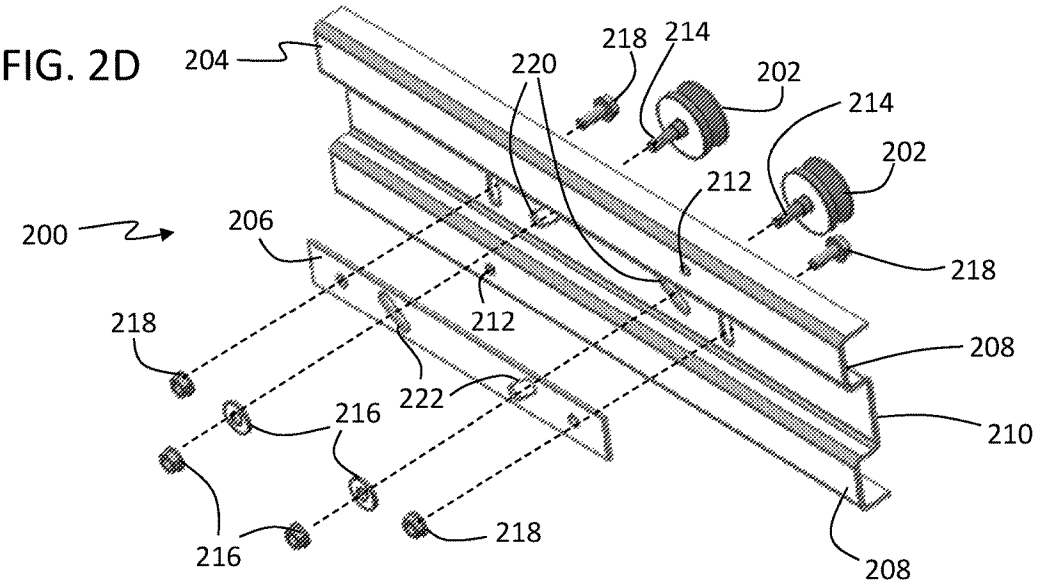
FIG. 2D is a second perspective, exploded illustration of the guide rail support of FIG. 2A.

Turning to FIGS. 2A-2D, various schematic illustrations of a guide rail support 200 in accordance with a non-limiting embodiment of the present disclosure are shown. FIG. 2A shows a first perspective illustration of the guide rail support 200 supporting a guide rail 209 of an elevator system. FIG. 2B shows an alternative perspective illustration of the guide rail support 200 supporting the guide rail 209. FIG. 2C is a first perspective, exploded illustration of the guide rail support 200. FIG. 2D is a second perspective, exploded illustration of the guide rail support 200.

As shown in FIGS. 2A-2D, the guide rail support 200 includes two rotating members 202 mounted to a guide rail bracket 204 and an adjustment bracket 206. The rotating members 202 are configured to rotatably engage with a portion of the guide rail 209, such as at the base thereof, as shown. Accordingly, in some embodiments, the rotating members 202 may include a rotating head defining or having clamp-like features to engage with the guide rail 209 while allowing for relative movement between the guide rail 209 and the rotating members 202. In some embodiments, the clamp-like features can include sliding clamps or sliding shoes that are configured to engage a surface of the clamp or shoe with a portion of the guide rail. Further, in some embodiments, the guide rail and/or part or all of the rotating members may be treated with lubricating materials to improve relative movement between the guide rail and the rotating members.

The guide rail bracket 204 includes a first mounting portion 208 and a second mounting portion 210. The first mounting portion 208 includes one or more wall mounting apertures 212 that are configured to receive wall fasteners (e.g., screws, bolts, nails, etc.) to mount the guide rail support 200 to a wall of an elevator shaft. The second mounting portion 210 is configured to receive the rotating members 202. The rotating members 202 each include an integral stem 214 that extends through the guide rail bracket 204 and the adjustment bracket 206. The rotating members 202 are positioned on a first side of the second mounting portion 210 and the adjustment bracket 206 is positioned on a second side of the second mounting portion 210, opposing the location of the rotating members 202, as shown.

As shown in FIGS. 2C-2D, the rotating members 202 are rotatably attached to the second mounting portion 210 and the adjustment bracket 206 by stem fasteners 216 that fasten to the integral stems 214 of the rotating members 202. As shown the stem fasteners 216 include nuts and washers that are configured to threadedly connect to the integral stems 214. However, those of skill in the art will appreciate that other types of fasteners may be used without departing from the scope of the present disclosure, including, but not limited to pin locks, lock nuts, etc. The rotating member 202 and the stem fasteners 216 support the guide rail bracket 204 and the adjustment bracket 206 therebetween.

The integral stems 214 of the rotating members 202 are configured to pass through inclined apertures 220 in the second mounting portion 210 and inclined apertures 222 in the adjustment bracket 206. As shown, and described below, the inclined apertures 220, 222 are oriented as opposites. The inclined apertures 220 in the second mounting portion 210 have a first angle relative to vertical (see, e.g., FIGS. 5A-5C). The inclined apertures 222 in the adjustment bracket 206 have a second angle relative to vertical that is opposite the first angle. The inclined apertures 220, 222 enable positioning of the rotating members 202 relative to a guide rail 209, as described below. In some non-limiting embodiments, by way of example, the inclined apertures 220 may be angled at about 45° relative to horizontal and the inclined apertures 222 may be rectangular to the inclined apertures 220. That is, the inclined apertures 220, 222, in some embodiments, are arranged at about 90° or normal to each other.

In accordance with some embodiments, the rotating member 202 and the stem fasteners 216 do not fixedly connect the guide rail bracket 204 and the adjustment bracket 206 together to allow for rotation of the rotating members, as described herein. Accordingly, the guide rail support 200 includes bracket fasteners 218 that fixedly attach or connect the guide rail bracket 204 and the adjustment bracket 206 together. As shown, the bracket fasteners 218 are bolts and nuts, although other fastening mechanisms are possible without departing from the scope of the present disclosure. The bracket fasteners 218 are configured to pass through vertical apertures 224 in the second mounting portion 210 of the guide rail bracket 204. Additionally, the bracket fasteners 218 pass through securing apertures 226 in the adjustment bracket 206.

Figure 3:
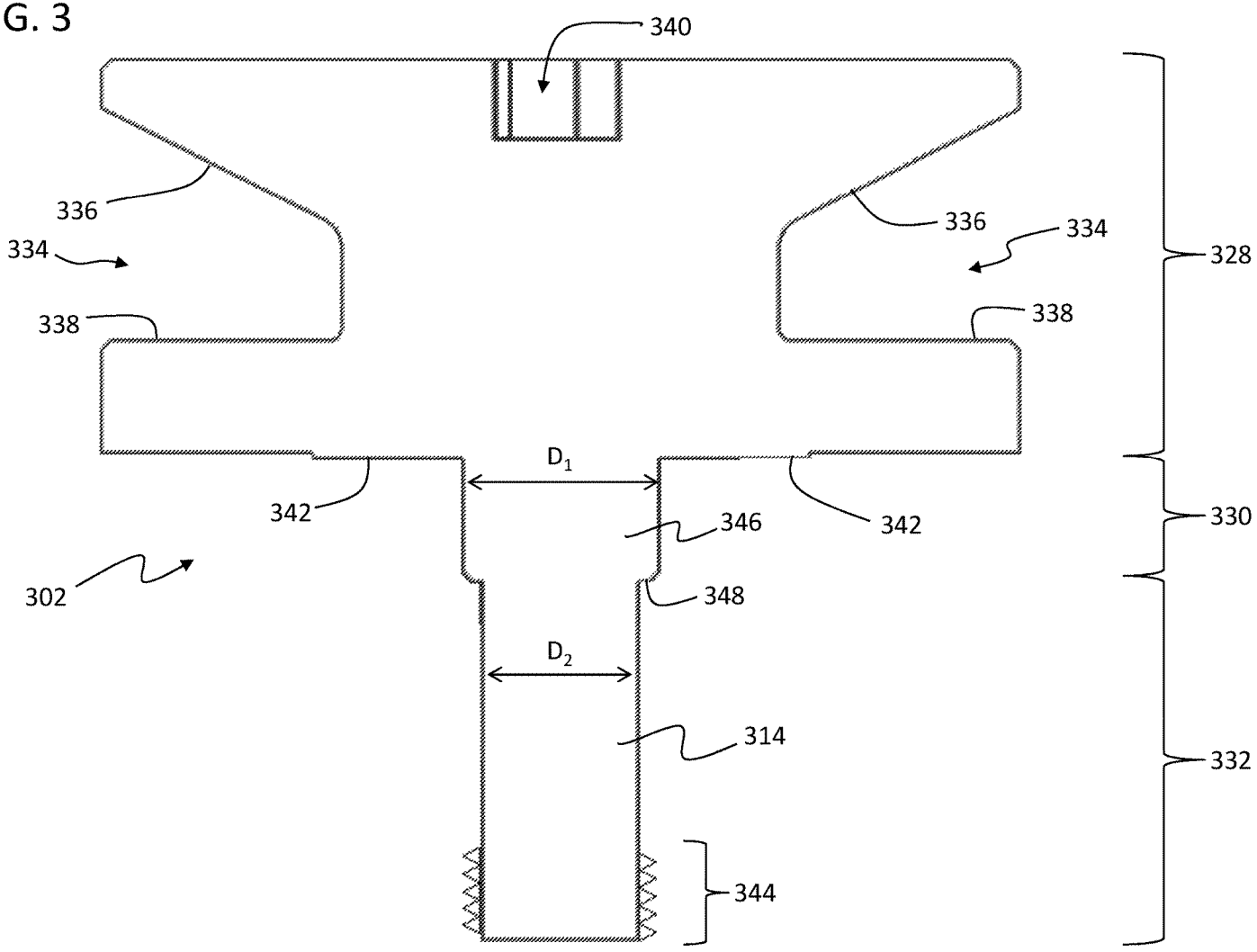
FIG. 3 is a cross-sectional schematic illustration of a rotating member in accordance with an embodiment of the present disclosure.

Turning now to FIG. 3, a cross-sectional schematic illustration of a rotating member 302 in accordance with an embodiment of the present disclosure is shown. The rotating member 302 is similar to the rotating members 202 of FIGS.

2A-2D and is configured to engage a guide rail to a guide rail support, as shown and described above. The rotating member 302 includes a first end 328 and a second end 332, with a middle 330 disposed between the first end 328 and the second end 332. The first end 328 includes a rotating head defining an engagement portion 334 that defines a volume or surfaces for engaging with a guide rail of an elevator system. For example, as shown, the engagement portion 334 includes a first engagement surface 336 and a second engagement surface 338, with the first engagement surface 336 inclined toward the second engagement surface 338. Because the first engagement surface 336 is inclined, the engagement portion 334 can receive different size guide rails.

The first end 328 further includes an inset 340 that can receive a tool for tightening the rotating member 302. Proximate to the middle 330, the first end 328 includes a contact surface 342. The contact surface 342 may, at times, contact a surface of a guide rail support (e.g., second mounting portion 210 shown in FIGS. 2A-2D).

The second end 332 includes an integral stem 314 of the rotating member 302 which extends from the middle 330. The second end 332 may include threading 344 or other features that enable the rotating member 302 to connect to a stem fastener or other device that secures the rotating member 302 to a guide rail support. In some embodiments the integral stem 314 may include an aperture to receive a pin lock or other device.

Located between the first end 328 and the second end 332 is the middle 330 which is defined by a shoulder portion 346. The shoulder portion 346 has a larger diameter than the integral stem 314, as shown in FIG. 3. That is, the shoulder portion 346 of the middle 330 has a first diameter $D_1$ and the second end 332 (e.g., integral stem 314) has a second diameter $D_2$. In some embodiments, the first diameter $D_1$ is greater than the second diameter $D_2$. Because of the difference in diameters, the shoulder portion 346 defines a stop surface 348. The stop surface 348 is configured to enable rotation of the rotating member 302 when installed to a guide rail support, as described below with respect to FIG. 4B.

Figure 4A:
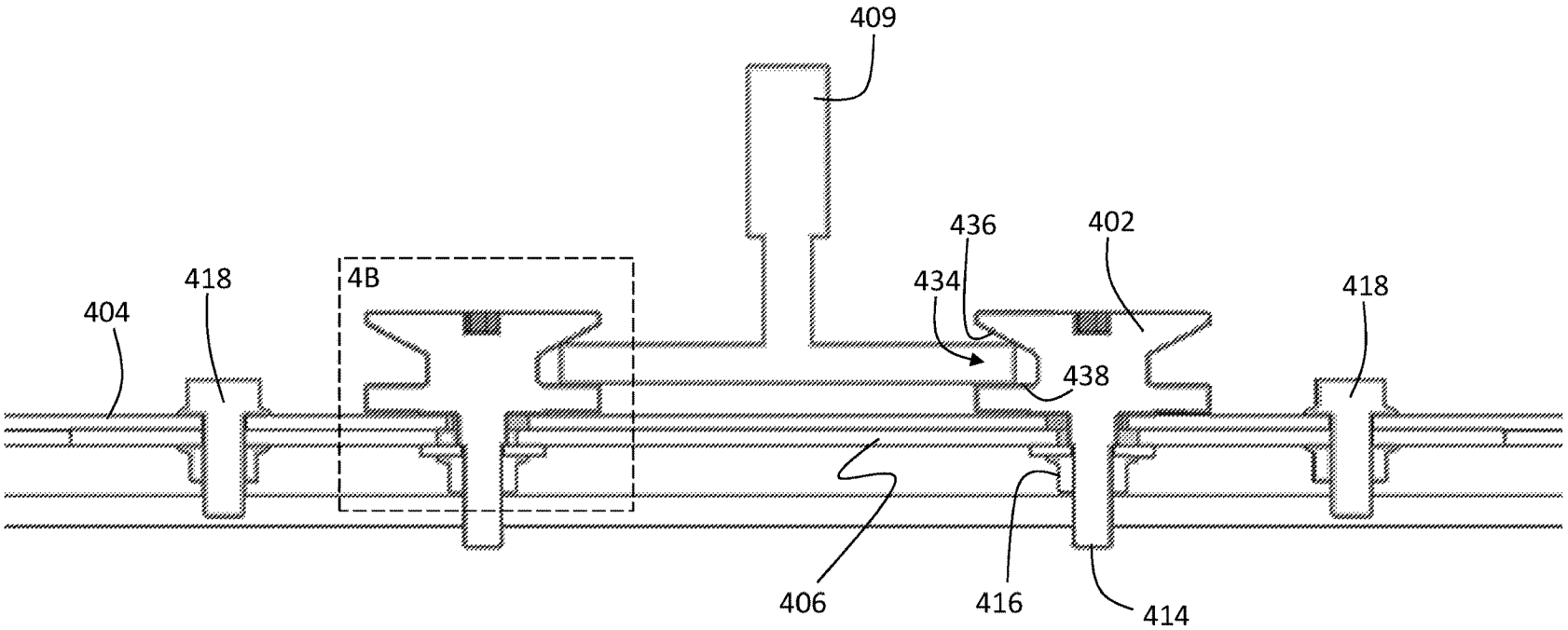
FIG. 4A is a top down, cross-sectional schematic illustration of a guide rail support in accordance with an embodiment of the present disclosure as engaged with a guide rail.
Figure 4B:
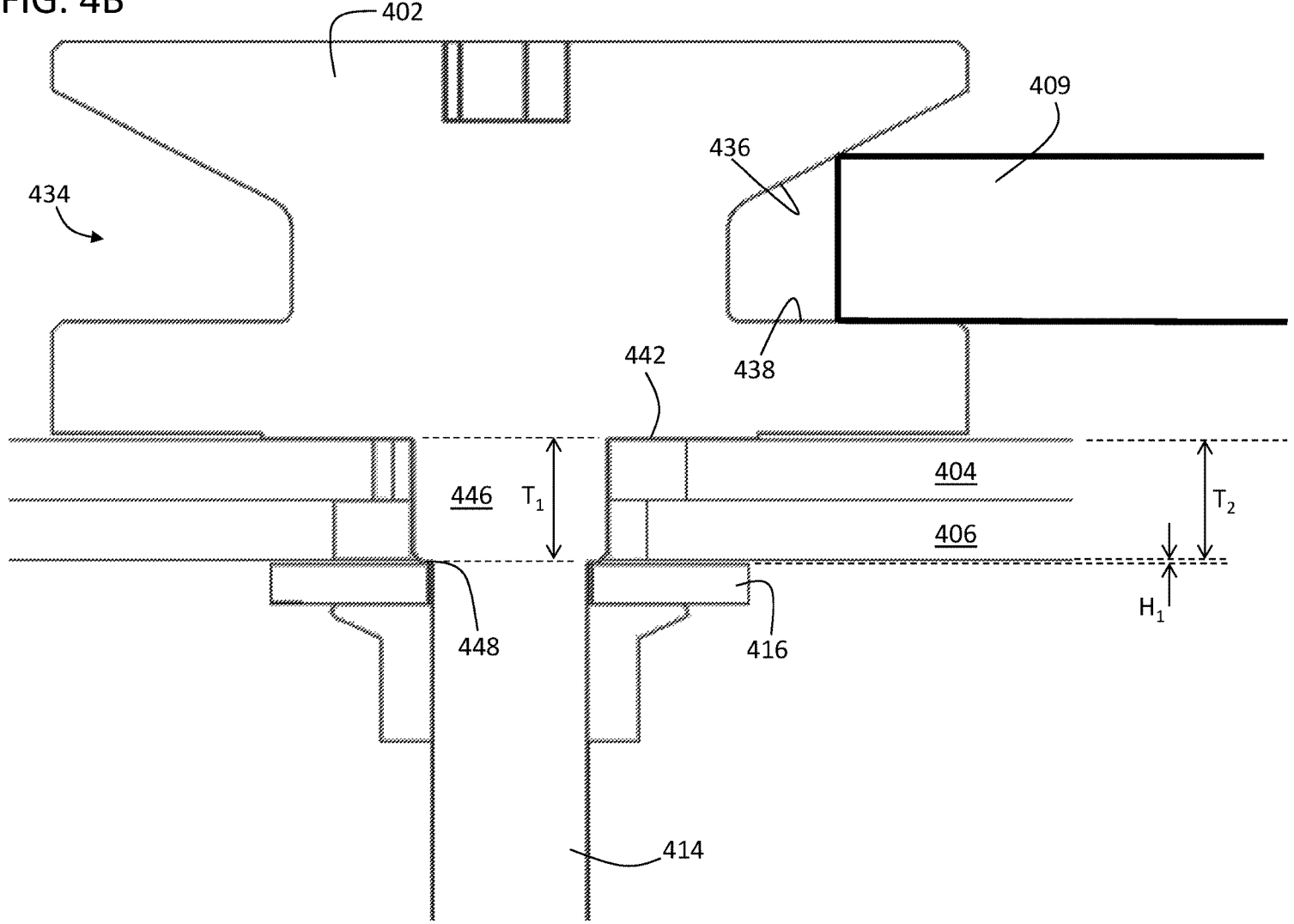
FIG. 4B is an enlarged view as indicated in FIG. 4A.

Turning now to FIGS. 4A and 4B, top-down, cross-sectional schematic views of an embodiment of the present disclosure are shown. FIG. 4A shows a top-down view of rotating members 402 as installed to a guide rail bracket 404 and an adjustment bracket 406. Also shown in FIG. 4A, the rotating members 402 are shown supporting and engaged with a guide rail 409. FIG. 4B shows an enlarged portion as indicated in the inset of FIG. 4A.

FIG. 4A shows the rotating members 402 rotatably fixed to the guide rail bracket 404 and the adjustment bracket 406 by stem fasteners 416. As shown, the stems 414 pass from a first side of the guide rail bracket 404 to a second side of the guide rail bracket 404, where the adjustment bracket 406 is located. As shown, the guide rail 409 is engaged by the rotating members 402 between a first surface 436 and a second surface 438 in an engagement portion 434.

As shown in FIG. 4B, a shoulder portion 446 of the rotating member 402 has a first thickness $T_1$. The first thickness $T_1$ of the shoulder portion 446 defines the length of the shoulder portion 446 extending from a contact surface 442 of the first end of the rotating member 402 to the integral stem 414 (e.g., a portion of the rotating member having an increased diameter relative to the stem). A second thickness $T_2$ is defined at a combined thickness of the guide rail bracket 404 and the adjustment bracket 406, as shown in FIG. 4B. The second thickness $T_2$ is less than the first thickness $T_1$, which forms a gap $H_1$ defined by the difference between the first thickness $T_1$ and the second thickness $T_2$. Accordingly, when a stem fastener 416 is connected to the integral stem 414, the guide rail bracket 404 and the adjustment bracket 406 are not physically contacted between the stem fastener 416 and the contact surface 442 of the rotating member 402. The gap $H_1$ enables a space (e.g., an air gap) such that the rotating member 402 has freedom to rotate relative to the guide rail bracket 404 and the adjustment bracket 406. In some non-limiting embodiments, by way of example, the gap $H_1$ may be a small clearance of about 0.1 mm. As noted above, the guide rail bracket 404 and the adjustment bracket 406 are fixedly connected by bracket fasteners 418, as shown in FIG. 4A.

Figure 5A:
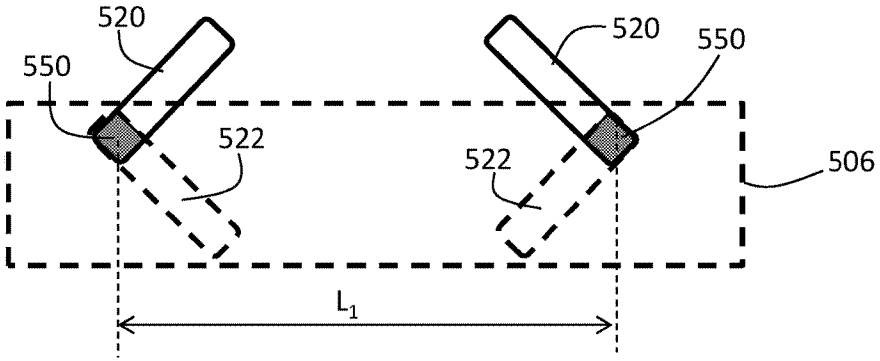
FIG. 5A is a schematic illustration of an adjustment bracket relative to a guide rail bracket forming stem apertures in accordance with an embodiment of the present disclosure, in a first position.
Figure 5B:
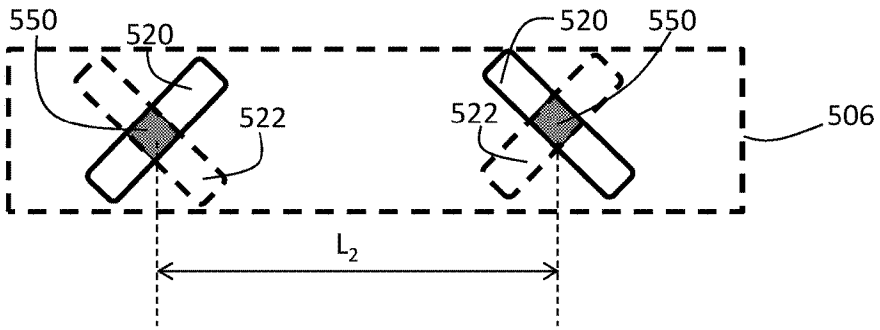
FIG. 5B is a schematic illustration of the brackets of FIG. 5A, in a second position.
Figure 5C:
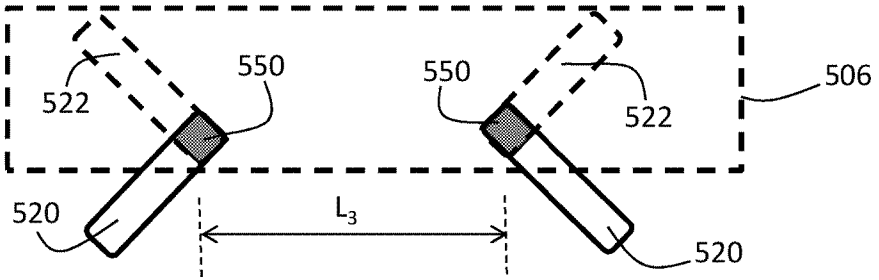
FIG. 5C is a schematic illustration of the brackets of FIG. 5A, in a third position.

Turning now to FIGS. 5A-5C, various schematic illustrations of how a guide rail bracket and an adjustment bracket move relative to each other during installation in accordance with an embodiment of the present disclosure are shown. FIG. 5A shows an adjustment bracket 506 in a first (e.g., upper) position; FIG. 5B shows the adjustment bracket 506 in a second (e.g., middle) position; and FIG. 5C shows the adjustment bracket 506 in a third (e.g., lower) position. In FIGS. 5A-5C, an adjustment bracket 506 is moved relative to inclined apertures 520 in a second mounting portion of a guide rail bracket (not shown, inclined apertures 520 shown in solid line). The adjustment bracket 506 is shown in dashed lines having inclined apertures 522 also shown in dashed lines.

The adjustment bracket 506 is adjusted relative to the second mounting portion of guide rail bracket such that stem apertures 550 through which an integral stem of a rotating member can pass are formed. The stem apertures 550 are an aperture that forms when the inclined apertures 520 in the second mounting portion of the guide rail bracket and the inclined apertures 522 of the adjustment bracket 506 are aligned.

As shown in FIG. 5A, the stem apertures 550 are positioned at a first position. The first position of the stem apertures 550 is when the stem apertures 550 are located at top of the adjustment bracket 506, e.g., when a bottom of the inclined apertures 520 align with a top of the inclined apertures 522. When the stem apertures 550 are in the first position, the stem apertures 550 are separated by a maximum first separation distance $L_1$. The first separation distance $L_1$ is a maximum separation distance between the two stem apertures 550. When stems of rotating members are passed through the stem apertures 550, the rotating members can engage a guide rail having a related first width. However, if the guide rail is smaller than the first width, then the rotating members can be adjusted, e.g., as shown in FIGS. 5B-5C, to accommodate a smaller width guide rail.

For example, turning now to FIG. 5B, the stem apertures 550 are positioned at a second position. The second position of the stem apertures 550 is when the stem apertures 550 are located at a middle of the adjustment bracket 506, e.g., when a middle of the inclined apertures 520 aligns with a middle of the inclined apertures 522. When the stem apertures 550 are in the second position, the stem apertures 550 are separated by a second separation distance $L_2$. The second separation distance $L_2$ is an intermediate separation distance between the two stem apertures 550. When stems of rotating members are passed through the stem apertures 550, the rotating members can engage a guide rail having a related second width that is less than the first width (e.g., FIG. 5A).

Turning now to FIG. 5C, the stem apertures 550 are positioned at a third position. The third position of the stem apertures 550 is when the stem apertures 550 are located at a bottom of the adjustment bracket 506, e.g., when a top of the inclined apertures 520 aligns with a bottom of the inclined apertures 522. When the stem apertures 550 are in the third position, the stem apertures 550 are separated by a minimum third separation distance $L_3$. The third separation distance $L_3$ is a minimum separation distance between the two stem apertures 550. When stems of rotating members are passed through the stem apertures 550, the rotating members can engage a guide rail having a related third width that is less than the second width (e.g., FIG. 5B). The third position represents the smallest width guide rail that the rotating members can accommodate. Those of skill in the art will appreciate that the diameter of the rotating member that engages with the guide rail can be adjusted to provide further or greater range of guide rail sizes to be supported by the guide rail support.

Figure 6:
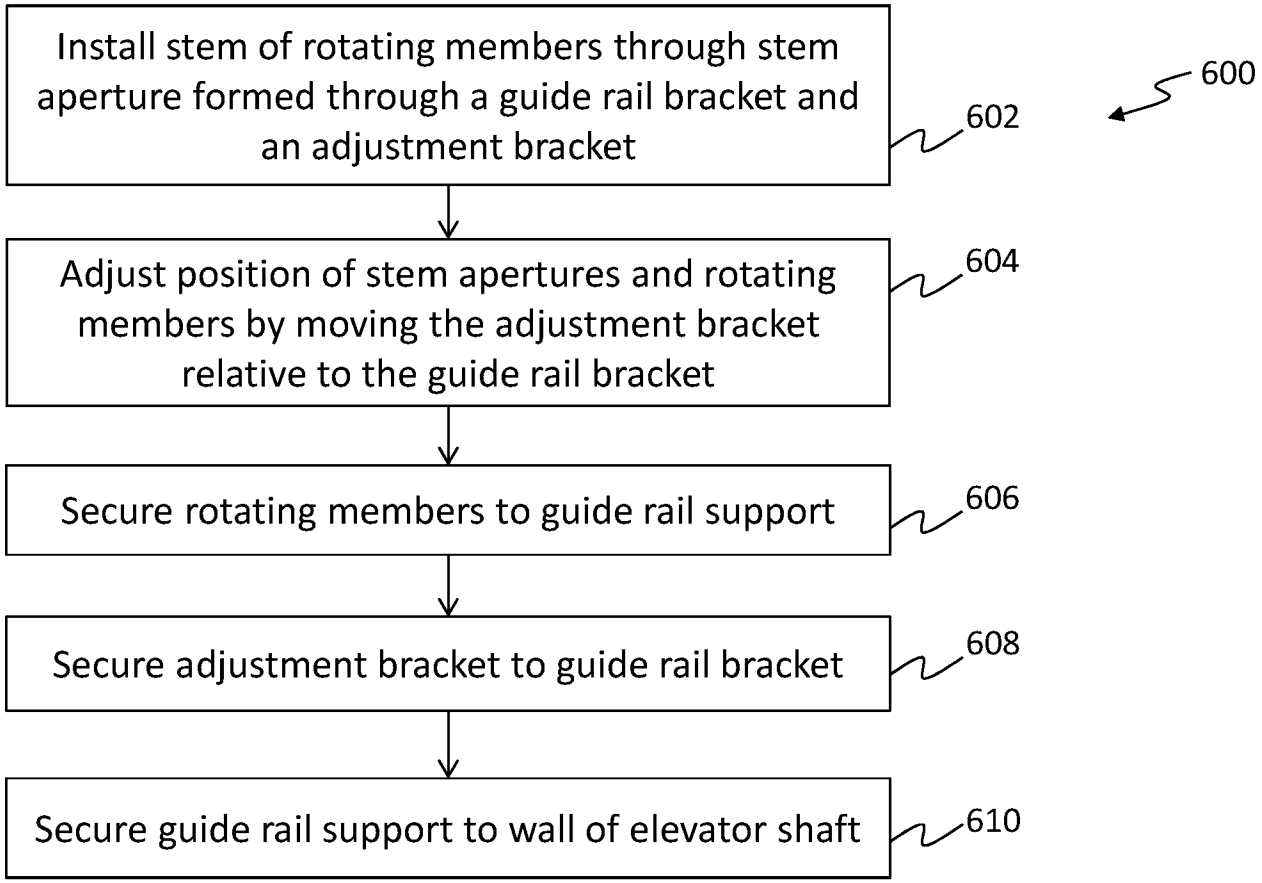
FIG. 6 is a flow process for installing a guide rail support and guide rail in accordance with an embodiment of the present disclosure.

Turning now to FIG. 6, a flow process for installing a guide rail to a guide rail support in accordance with an embodiment of the present disclosure is shown. The flow process 600 can be used with guide rail brackets and adjustment brackets as described above and can be used for installation with guide rails having a variety of widths. Further, after installation, the rotating members of the guide rail brackets described herein can enable relative movement between the guide rail brackets and the guide rails such that forces and pressures are not imparted to the guide rail from the guide rail brackets due to building settling. The relative movement is achieved by rotation of the rotating elements after engagement with the guide rail.

At block 602 integral stems of rotating members are installed or inserted through stem apertures that are formed between aligned inclined apertures of an adjustment bracket and a guide rail bracket that collectively form a guide rail support. With the stems inserted into the stem apertures, prior to securing a guide rail between the rotating members (see block 606), the position of the rotating members can be adjusted, both vertically and horizontally. At block 602, the guide rail support may be positioned within an elevator shaft between a guide rail and a wall of the elevator shaft.

At block 604, the guide rail is positioned between the rotating members by adjusting the stem apertures and rotating members. This may be achieved by adjusting the position of the adjustment bracket relative to the guide rail bracket. By moving the adjustment bracket relative to the guide rail bracket, the distance between the stem apertures can be increased or decreased to different separation distances. The adjustment may be made such that rotating members can contact and engage the guide rail between the rotating members, thus securing the guide rail between the rotating members.

At block 606 the rotating members are secured to the guide rail support. As discussed above, a stem fastener can be attached to the integral stem opposite the rotating member. However, a gap may be present such that rotation of the rotating member is possible relative to the guide rail bracket/adjustment bracket.

At block 608 the adjustment bracket is secured to the guide rail bracket. One or more bracket fasteners can be used to secure the two brackets together.

At block 610 the guide rail support is secured to the wall of the elevator shaft. One or more wall fasteners can be used to fixedly secure the guide rail support to the wall of the elevator shaft to provide support to the guide rail while allowing relative movement between the rotating members and the guide rail. That is, as secured and installed, the guide rail support provides support to the guide rail but also prevents forces to be applied to the guide rail due to building settling because the guide rail is not fixedly secured to the guide rail support and/or the wall of the elevator shaft.

The flow process 600 is provided as a non-limiting example. There may be many variations to the process or the individual steps (or operations) described therein without departing from the scope of the present disclosure. For instance, the steps may be performed in a differing order, or steps may be added, deleted or modified. All of these variations are considered a part of the present disclosure. For example, block 612 may be performed first, by securing the guide rail bracket to the wall of the elevator shaft and then the adjustment can be made as described herein.

Advantageously, embodiments provided herein enable use of different guide rail sections (having same or different guide rail base widths, shapes, geometries, etc.) on the same guide rail track while preventing building settling from affecting the guide rail. Further, advantageously, embodiments provided herein can eliminate a need to increase or change a guide rail cross-section. The relative movement enabled by the rotating members of embodiments provided herein allows relative movement between the guide rail and the building without imparting any additional force to the guide rail.

Further, advantageously, cost reduction may be achieved by employing embodiments provided herein, especially for mid- and high-rise structures (and associated elevator shafts) as a single cross-section structure of a guide rail can be used. That is, there may be no need to install different sections of guide rails having different cross-sections. For example, above a certain limit of rise, the weight of the guide rail track and width of the guide rail may be required to be increased to accommodate the increased weight and forces of a taller or higher building/structure. However, embodiments provided herein can eliminate this change in guide rail cross-section by enabled guide rail support that accounts for building settling.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

For example, although described with a particular structural configuration, those of skill in the art will appreciate that the geometry of the guide rail supports, as provided herein, may be varied or different without departing from the scope of the present disclosure. Further, although described with respect to a roped elevator system, those of skill in the art will appreciate that elevator guide rails may incorporate features of embodiments described herein in any type of elevator system, without departing from the scope of the present disclosure.

Accordingly, the present disclosure is not to be seen as limited by the foregoing description, but is only limited by the scope of the appended claims.

What is claimed is:

1. A guide rail support for a guide rail of an elevator system, the guide rail support comprising:

a guide rail bracket having a first side, a second side opposite the first side, a first mounting portion, and a second mounting portion, the first mounting portion configured to fixedly attach to a wall of an elevator shaft, the guide rail bracket having at least two inclined apertures defining elongated slots formed on a planar face of the second mounting portion;

an adjustment bracket configured to contact the second side of the guide rail bracket at the second mounting portion, the adjustment bracket having at least two inclined apertures defining elongated slots formed on a planar face of the adjustment bracket and are configured to align with the inclined apertures of the guide rail bracket to define respective stem apertures;

a first rotating member configured to be installed through one of the stem apertures; and a second rotating member configured to be installed through the other of the stem apertures, wherein each rotating member has (i) a first end defining a rotating head configured to movably engage with a base of the guide rail, (ii) an integrally formed stem configured to pass through the respective stem aperture and define a second end, and (iii) a middle integrally formed between the first end and the second end, the middle defining a length that is greater than a thickness of the guide rail bracket and the adjustment bracket.

2. The guide rail support of claim 1, wherein the inclined apertures of the guide rail bracket are perpendicular to the inclined apertures of the adjustment bracket.

3. The guide rail support of claim 1, wherein the inclined apertures of the adjustment bracket are set at about 45° from horizontal.

4. The guide rail support of claim 1, further comprising at least one bracket fastener configured to fixedly connect the adjustment bracket to the guide rail bracket.

5. The guide rail support of claim 1, further comprising at least one wall fastener configured to fixedly connect the guide rail bracket to the wall of the elevator shaft.

6. The guide rail support of claim 1, wherein the second mounting portion includes one or more vertical apertures configured to align with one or more securing apertures formed in the adjustment bracket.

7. The guide rail support of claim 1, wherein the middle of each rotating member includes a stop surface configured to stop a part of a stem fastener that engages with the integrally formed stem of the respective rotating member such that a gap is formed between the stem fastener and a surface of the adjustment bracket.

8. The guide rail support of claim 7, wherein the gap is about 0.1 mm.

9. The guide rail support of claim 1, wherein each rotating member includes an engagement portion defined by a first surface and a second surface, the first surface being inclined relative to the second surface, the engagement portion configured to receive a portion of a guide rail.

10. The guide rail support of claim 1, wherein the stem apertures are separated by a first separation distance when the adjustment bracket is in a first position and the stem apertures are separated by a second separation distance when the adjustment bracket is in a second position.

11. The guide rail support of claim 1, wherein each rotating member includes a clamp-like structure configured to engage with the guide rail.

12. A method of installing a guide rail in an elevator shaft comprising:

installing a first rotating member and a second rotating member into a guide rail support, wherein each rotating member includes an integral stem that is installed through a stem aperture formed through the guide rail support having a guide rail bracket and an adjustment bracket, wherein:

the guide rail bracket has a first side, a second side opposite the first side, a first mounting portion, and a second mounting portion, the first mounting portion configured to fixedly attach to a wall of the elevator shaft, the guide rail bracket having at least two inclined apertures defining elongated slots formed on a planar face of the second mounting portion, the adjustment bracket is configured to contact the second side of the guide rail bracket at the second mounting portion, the adjustment bracket having at least two inclined apertures defining elongated slots formed on a planar face of the adjustment bracket and are configured to align with the inclined apertures of the guide rail bracket to define respective stem apertures, and wherein each rotating member has (i) a first end defining a rotating head configured to movably engage with a base of the guide rail, (ii) an integrally formed stem configured to pass through the respective stem aperture and define a second end, and (iii) a middle integrally formed between the first end and the second end, the middle defining a length that is greater than a thickness of the guide rail bracket and the adjustment bracket;

adjusting relative positions of the stem apertures by adjusting a position of the adjustment bracket relative to the guide rail bracket;

engaging the guide rail between the two rotating members such that the rotating members are rotatable with respect to the guide rail; and fixedly connecting the guide rail bracket to the adjustment bracket.

13. The method of claim 12, further comprising fixedly connecting the guide rail bracket to the wall of the elevator shaft.

14. The method of claim 12, further comprising adjusting a position of the stem aperture between (i) a first position where the stem apertures are separated by a first separation distance and (ii) a second position where the stem apertures are separated by a second separation distance, wherein the first separation distance is greater than the second separation distance.

15. The method of claim 12, further comprising securing the guide rail bracket and the adjustment bracket between a first end of each rotating member and a stem fastener attached at a second end of each rotating member, wherein a gap is formed between the stem fasteners and the adjustment bracket.

* * * * *